US008357879B2

(12) United States Patent
Choi et al.

(10) Patent No.: US 8,357,879 B2
(45) Date of Patent: Jan. 22, 2013

(54) MICRO-HEATERS, MICRO-HEATER ARRAYS, METHODS FOR MANUFACTURING THE SAME AND ELECTRONIC DEVICES USING THE SAME

(75) Inventors: Junhee Choi, Seongnam-si (KR); Andrei Zoulkarneev, Suwon-si (KR)

(73) Assignee: Samsung Electronics Co., Ltd., Gyeonggi-Do (KR)

( * ) Notice: Subject to any disclaimer, the term of this patent is extended or adjusted under 35 U.S.C. 154(b) by 1146 days.

(21) Appl. No.: 12/149,947

(22) Filed: May 9, 2008

(65) Prior Publication Data

US 2009/0139974 A1 Jun. 4, 2009

(30) Foreign Application Priority Data

Nov. 30, 2007 (KR) ..... 10-2007-0123797

(51) Int. Cl.
*F27D 11/00* (2006.01)
*B05D 5/06* (2006.01)

(52) U.S. Cl. ..... 219/385; 219/544; 427/66; 427/256; 205/105

(58) Field of Classification Search ..... 219/385, 219/544; 427/66, 256; 205/104
See application file for complete search history.

(56) References Cited

U.S. PATENT DOCUMENTS

| | | | |
|---|---|---|---|
| 3,745,508 | A | 7/1973 | Bruder et al. |
| 4,374,312 | A | 2/1983 | Damron |
| 4,478,077 | A | 10/1984 | Bohrer et al. |
| 4,510,036 | A | 4/1985 | Takeuchi et al. |
| 4,651,564 | A | 3/1987 | Johnson et al. |
| 4,696,188 | A | 9/1987 | Higashi |
| 5,288,973 | A | 2/1994 | Ota et al. |
| 5,780,524 | A | 7/1998 | Olsen |

(Continued)

FOREIGN PATENT DOCUMENTS

| | | |
|---|---|---|
| JP | 07-022315 | 1/1995 |
| JP | 2002-124466 | 4/2002 |

(Continued)

OTHER PUBLICATIONS

European Search Report, dated Sep. 16, 2011, for Application 08157114.3-1242/2066147.

(Continued)

*Primary Examiner* — Shawntina Fuqua
(74) *Attorney, Agent, or Firm* — Harness, Dickey & Pierce, P.L.C.

(57) ABSTRACT

Example embodiments provide micro-heaters including a heating section, a plurality of connecting sections, and a plurality of support structures. The heating section is on the substrate, separated from the substrate and extended in a longitudinal direction. The plurality of connecting sections are arranged at a distance from each other in the longitudinal direction of the heating section, and extended from two sides of the heating section in a perpendicular direction with respect to the longitudinal direction of the heating section. The plurality of support structures are formed between the substrate and the plurality of connecting sections, so as to support the heating section and the plurality of connecting sections from underneath the plurality of connecting sections. Therefore, since the heating section and the plurality of support structures are separated from each other by the plurality of connecting sections, temperature distribution on the heating section is not influenced by the shape of each one of the plurality of support structures. Consequently, temperature distribution on the heating section may be more uniform and power consumption of the micro-heater may decrease.

18 Claims, 10 Drawing Sheets

U.S. PATENT DOCUMENTS

| | | | | |
|---|---|---|---|---|
| 6,091,050 | A | 7/2000 | Carr | |
| 6,331,074 | B1 | 12/2001 | Kimura | |
| 6,460,966 | B1 | 10/2002 | Hellekson et al. | |
| 6,705,152 | B2 | 3/2004 | Routkevitch et al. | |
| 6,896,780 | B2 | 5/2005 | Yang et al. | |
| 7,049,556 | B2 | 5/2006 | Aoki et al. | |
| 7,119,656 | B2 | 10/2006 | Landsberger et al. | |
| 7,329,361 | B2 | 2/2008 | Guha et al. | |
| 7,525,071 | B2 | 4/2009 | Goto et al. | |
| 7,533,564 | B2 | 5/2009 | Pan et al. | |
| 7,807,483 | B2 | 10/2010 | Yamazaki et al. | |
| 7,932,112 | B2 | 4/2011 | Yokoyama et al. | |
| 7,999,211 | B2 | 8/2011 | Ruiz et al. | |
| 2004/0178879 | A1 | 9/2004 | Mitra et al. | |
| 2006/0141135 | A1 * | 6/2006 | Wang et al. | 427/66 |
| 2007/0052024 | A1 | 3/2007 | Lee et al. | |
| 2009/0020760 | A1 | 1/2009 | Choi et al. | |
| 2009/0223557 | A1 | 9/2009 | Park et al. | |
| 2009/0250112 | A1 | 10/2009 | Choi et al. | |
| 2009/0256169 | A1 | 10/2009 | Yokoyama et al. | |
| 2009/0289049 | A1 | 11/2009 | Choi | |
| 2009/0304371 | A1 | 12/2009 | Choi | |
| 2010/0187662 | A1 | 7/2010 | Choi et al. | |
| 2010/0193505 | A1 | 8/2010 | Peck | |
| 2011/0090184 | A1 | 4/2011 | Yamazaki et al. | |
| 2011/0193124 | A1 | 8/2011 | Yokoyama et al. | |
| 2012/0132643 | A1 | 5/2012 | Choi et al. | |

FOREIGN PATENT DOCUMENTS

| | | |
|---|---|---|
| JP | 2004-087143 | 3/2004 |
| JP | 2004-269968 | 9/2004 |
| JP | 2005/150061 | 6/2005 |
| JP | 2006-047276 | 2/2006 |
| JP | 2006-286372 | 10/2006 |
| JP | 2010-278142 | 12/2010 |
| KR | 10-2002-0090428 | 12/2002 |
| KR | 20-0358225 | 8/2004 |
| KR | 10-2004-0103726 | 12/2004 |
| KR | 10-2006-0062139 | 6/2006 |
| KR | 10-2006-0110201 | 10/2006 |
| KR | 10-2007-0009804 | 1/2007 |
| KR | 10-2009-0066644 | 6/2009 |

OTHER PUBLICATIONS

US Office Action, dated Sep. 29, 2009, for Co-pending U.S. Appl. No. 12/149,939.

US Office Action, dated Feb. 18, 2010, for Co-pending U.S. Appl. No. 12/149,939.

US Office Action, dated Sep. 14, 2010, for Co-pending U.S. Appl. No. 12/149,939.

US Office Action, dated Jan. 26, 2011, for Co-pending U.S. Appl. No. 12/149,939.

US Office Action dated Sep. 13, 2011 for Co-pending U.S. Appl. No. 12/149,884.

US Office Action, dated Sep. 27, 2011, for Co-pending U.S. Appl. No. 12/289,439.

US Office Action, dated Oct. 6, 2011, for Co-pending U.S. Appl. No. 12/149,939.

S. Dittmer et al., "Low ambient temperature CVD growth of carbon nanotubes," pp. 243-246, (2006).

Onigi Englander et al., "Local synthesis of silicon nanowires and carbon nanotubes on microbridges," pp. 4797-4799, (2003).

US Office Action dated Mar. 5, 2012 issued in co-pending U.S. Appl. No. 12/149,884.

US Office Action dated Mar. 16, 2012 issued in co-pending U.S. Appl. No. 12/289,439.

US Office Action dated Jul. 16, 2012 issued in co-pending U.S. Appl. No. 12/289,440.

US Office Action dated Aug. 30, 2012 issued in co-pending U.S. Appl. No. 12/149,884.

* cited by examiner

MICRO-HEATERS, MICRO-HEATER ARRAYS, METHODS FOR MANUFACTURING THE SAME AND ELECTRONIC DEVICES USING THE SAME

PRIORITY STATEMENT

This application claims priority to Korean Patent Application No. 10-2007-0123797 filed on Nov. 30, 2007, under 35 U.S.C. §119, the contents of which in their entirety are herein incorporated by reference.

BACKGROUND

1. Field

Example embodiments relate to micro-heaters, micro-heater arrays, methods for manufacturing the same and electronic devices using the same.

2. Discussion of Related Art

A micro-heater locally warms the surface of a substrate to a high temperature as power is supplied, and may be applied to a broad range of electronic devices, for example, carbon nano tube transistors, low-temperature polycrystalline silicon or thin film transistors, field emission sources of a backlight unit, etc., which require high-temperature fabrication processes or high-temperature operations.

To use a micro-heater for electronic devices, a micro-heater needs to exhibit a uniformly heated state overall as well as be capable of adjusting temperature locally. Moreover, by reducing the loss of heat from a micro-heater, the power being applied to a micro-heater may be utilized more efficiently for heating a micro-heater to high temperatures.

In general, a micro-heater includes heating elements that are arranged at a distance from a substrate, and a plurality of support structures provided underneath the heating elements to support portions of the heating elements. In this type of micro-heater, heating elements may come into direct contact with the support structure, resulting in the heat generated by the heating elements transferring to and being lost in the support structure. In addition, if the support structures have various sizes or shapes, contact areas between the heating elements and the support structures may be different from each other in terms of size or shape, resulting in non-uniform temperature distribution. Under such a non-uniform temperature distribution, some of the heating elements may disconnect causing a malfunction of the micro-heater to malfunction. Also, as a great deal of the heat generated from the heating elements is lost, a micro-heater's driving power may be wasted.

SUMMARY

Example embodiments provide micro-heaters having uniform temperature distributions and reduced power consumption, micro-heater arrays, and electronic devices using the same. Example embodiments also provide methods for manufacturing the micro-heaters.

Example embodiments include a micro-heater on a substrate including a heating section, a plurality of connecting sections, and a plurality of support structures. The heating section may be over the substrate separate from the substrate and extended in a longitudinal direction. The connecting sections may be arranged at a distance from each other in the longitudinal direction of the heating section, and extended from two sides of the heating section in a perpendicular direction with respect to the longitudinal direction of the heating section. The support structures may be formed between the substrate and the plurality of connecting sections, so as to support the heating section and the connecting sections from underneath the connecting sections.

According to example embodiments, each of the plurality of connecting sections may be divided into a first area and a second area. The first area may correspond to a contact area between each of the connecting sections and each of the support structures, and the second area may be formed between the heating section and the first area and have a smaller width than a width of the first area. According to example embodiments, the width of the second area may be smaller than a width of the heating section, and the contact area between each of the connecting sections and each of the support structures may be smaller than the first area in each of the connecting sections.

Example embodiments also provide micro-heater arrays including two or more micro-heaters formed in parallel on the substrate. Example embodiments also provide electronic devices including the micro-heaters or the micro-heater arrays described above.

Other example embodiments provide methods for manufacturing a micro-heater, including forming a sacrificial layer on a substrate, forming a heating layer on the sacrificial layer, patterning the heating layer into a heating section and a plurality of connecting sections, wherein the heating section is extended in a longitudinal direction, and the plurality of connecting sections are arranged at a distance from each other in a longitudinal direction of the heating section and extended from two sides of the heating section in a perpendicular direction with respect to the longitudinal direction of the heating section, and etching the sacrificial layer except for a contact area between each of the connection sections and each of a plurality of support structures, wherein the support structures are underneath the connecting sections and support the heating section. Each of the connecting sections may be patterned into a first area corresponding to a contact area between each of the connecting sections and each of the support structures; and a second area between the heating section and the first area and having a smaller width than a width of the first area.

The second area may be formed to have a smaller width than a width of the heating section. The contact area between each of the connecting sections and each of the support structures decreases in size so as to reduce heat transfer between the connecting sections and the support structures without impairing the structural support of the support structures in supporting the heating section and the connecting sections. Also, the contact area may be smaller than the first area in each of the connecting sections.

BRIEF DESCRIPTION OF THE DRAWINGS

Example embodiments will be more clearly understood from the following detailed description taken in conjunction with the accompanying drawings.

FIG. 1 is a perspective view of a micro-heater in accordance with example embodiments;

FIG. 2 is a cross-sectional view taken along line I-I' of FIG. 1;

FIG. 3 is a plain view of the micro-heater illustrated in FIG. 1;

FIG. 4 is a perspective view of a micro-heater array in accordance with example embodiments;

FIGS. 7A through 7C illustrate successive stages in the manufacture of a micro-heater array in accordance with example embodiments in which FIGS. 7A and 7C are side views and FIG. 7B is a plain view.

DETAILED DESCRIPTION OF EXAMPLE EMBODIMENTS

Figure 1:
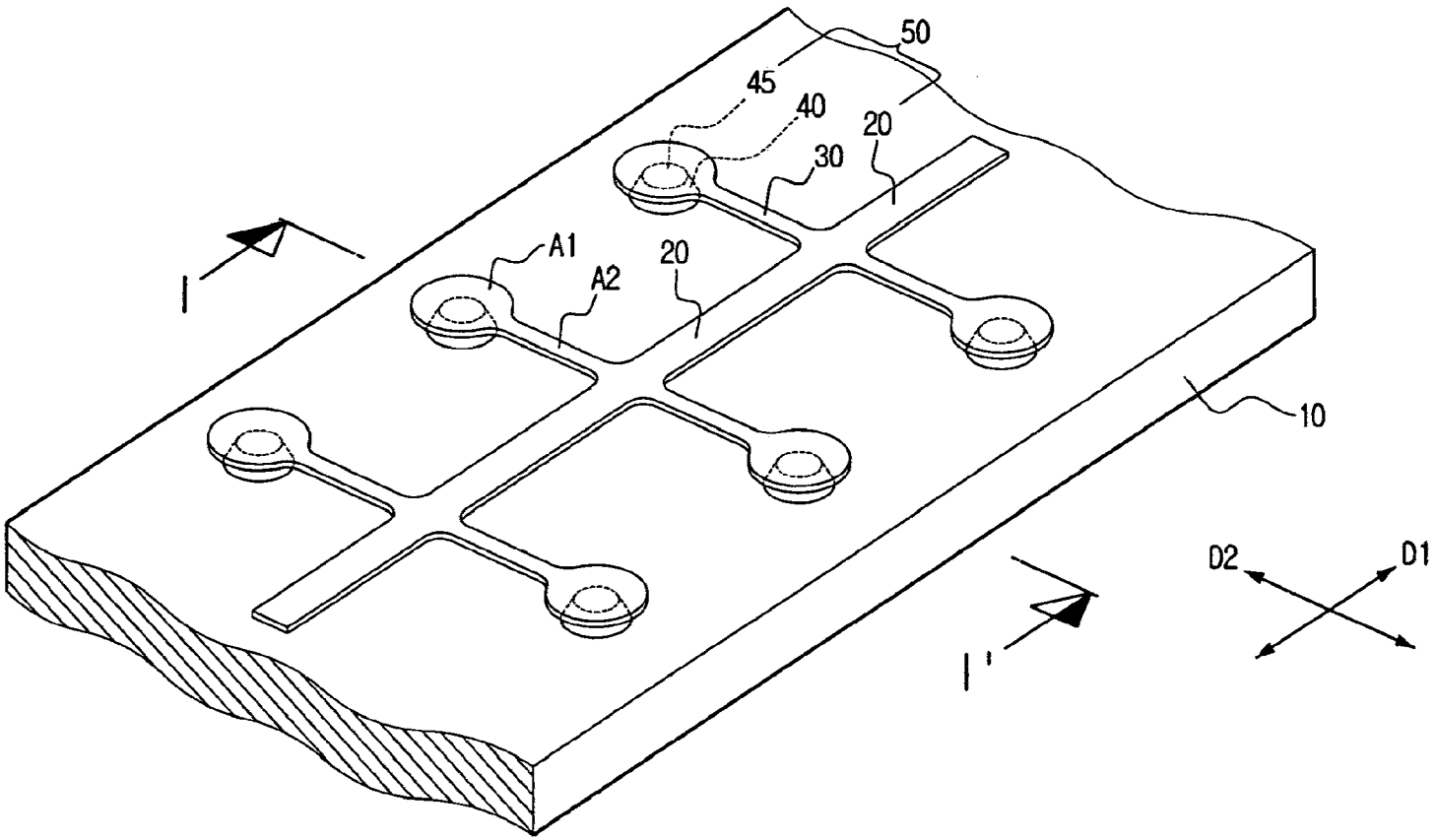
FIGS. 1-4 represent non-limiting, example embodiments as described herein.

Various example embodiments will now be described more fully with reference to the accompanying drawings in which some example embodiments are shown. In the drawings, the thicknesses of layers and regions may be exaggerated for clarity.

Detailed illustrative embodiments are disclosed herein. However, specific structural and functional details disclosed herein are merely representative for purposes of describing example embodiments. This invention may, however, may be embodied in many alternate forms and should not be construed as limited to only example embodiments set forth herein.

Accordingly, while example embodiments are capable of various modifications and alternative forms, embodiments thereof are shown by way of example in the drawings and will herein be described in detail. It should be understood, however, that there is no intent to limit example embodiments to the particular forms disclosed, but on the contrary, example embodiments are to cover all modifications, equivalents, and alternatives falling within the scope of the invention. Like numbers refer to like elements throughout the description of the figures.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of example embodiments. As used herein, the term "and/or" includes any and all combinations of one or more of the associated listed items.

It will be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present. Other words used to describe the relationship between elements should be interpreted in a like fashion (e.g., "between" versus "directly between," "adjacent" versus "directly adjacent," etc.).

The terminology used herein is for the purpose of describing particular embodiments only and is not intended to be limiting of example embodiments. As used herein, the singular forms "a," "an" and "the" are intended to include the plural forms as well, unless the context clearly indicates otherwise. It will be further understood that the terms "comprises," "comprising," "includes" and/or "including," when used herein, specify the presence of stated features, integers, steps, operations, elements and/or components, but do not preclude the presence or addition of one or more other features, integers, steps, operations, elements, components and/or groups thereof.

It will be understood that, although the terms first, second, third etc. may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the scope of example embodiments.

Spatially relative terms, such as "beneath," "below," "lower," "above," "upper" and the like, may be used herein for ease of description to describe one element or a relationship between a feature and another element or feature as illustrated in the figures. It will be understood that the spatially relative terms are intended to encompass different orientations of the device in use or operation in addition to the orientation depicted in the Figures. For example, if the device in the figures is turned over, elements described as "below" or "beneath" other elements or features would then be oriented "above" the other elements or features. Thus, for example, the term "below" can encompass both an orientation which is above as well as below. The device may be otherwise oriented (rotated 90 degrees or viewed or referenced at other orientations) and the spatially relative descriptors used herein should be interpreted accordingly.

Example embodiments are described herein with reference to cross-sectional illustrations that are schematic illustrations of idealized embodiments (and intermediate structures). As such, variations from the shapes of the illustrations as a result, for example, of manufacturing techniques and/or tolerances, may be expected. Thus, example embodiments should not be construed as limited to the particular shapes of regions illustrated herein but may include deviations in shapes that result, for example, from manufacturing. For example, an implanted region illustrated as a rectangle may have rounded or curved features and/or a gradient (e.g., of implant concentration) at its edges rather than an abrupt change from an implanted region to a non-implanted region. Likewise, a buried region formed by implantation may result in some implantation in the region between the buried region and the surface through which the implantation may take place. Thus, the regions illustrated in the figures are schematic in nature and their shapes do not necessarily illustrate the actual shape of a region of a device and do not limit the scope.

It should also be noted that in some alternative implementations, the functions/acts noted may occur out of the order noted in the figures. For example, two figures shown in succession may in fact be executed substantially concurrently or may sometimes be executed in the reverse order, depending upon the functionality/acts involved.

Unless otherwise defined, all terms (including technical and scientific terms) used herein have the same meaning as commonly understood by one of ordinary skill in the art to which example embodiments belong. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

In order to more specifically describe example embodiments, various aspects will be described in detail with reference to the attached drawings. However, example embodiments are not limited to those described.

Hereinafter, embodiments of example embodiments will be set forth in detail with reference to the accompanying drawings so that those skilled in the art can easily carry out the invention.

Figure 2:
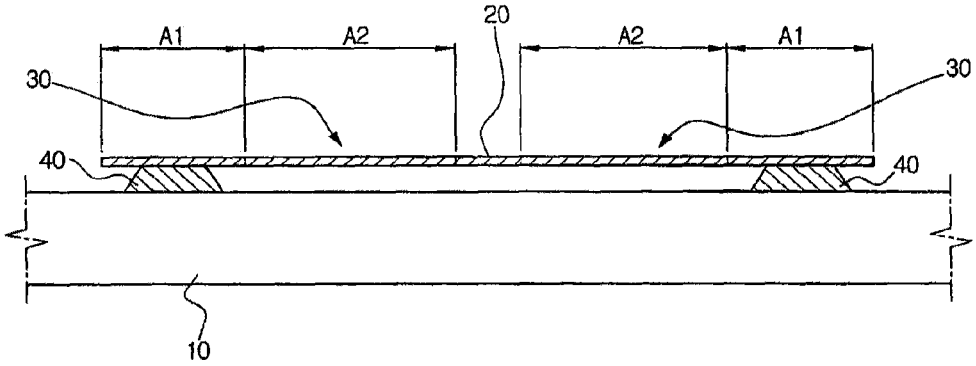

FIG. 1 is a perspective view of a micro-heater in accordance with example embodiments, and FIG. 2 is a cross-sectional view taken along line I-I' of FIG. 1. Referring to FIGS. 1 and 2, a micro-heater 50 is formed on a substrate 10, and includes a heating section 20, a plurality of connecting sections 30, and a plurality of support structures 40.

The heating section 20 is arranged over and a distance from the substrate 10, being extended in a direction D1. The heating section 20 may be made out of molybdenum, tungsten, silicon carbide, etc., and may emit light or generate heat when power is applied thereto. The substrate 10 may be made out of a silicon wafer or insulating material, e.g., glass, etc. If the substrate 10 is made out of glass, radiant heat (visible rays and/or IR) may penetrate the glass substrate so that the substrate may be heated to relatively high temperatures.

The plurality of connecting sections 30 may be arranged at a distance from each other and in a longitudinal direction of the heating section 20 on the substrate 10, and extended from two sides of the heating section 20 in a perpendicular direction D2 with respect to the longitudinal direction D1 of the heating section 20. Referring to FIG. 1, the plurality of connecting sections 30 are divided into two parts by the heating section 20. As shown in FIG. 1, the plurality of connecting sections 30 are extended orthogonally to the longitudinal direction D1 of the heating section 20 and arranged symmetrically to the heating section 20. In other example embodiments, the connecting sections 30 may be arranged in various other layouts and directions on either or two sides of the heating section 20. For example, the connecting sections 30 may alternate position and side, the connecting sections 30 may extend obliquely with respect to direction D1, etc. The connecting sections 30 may be made out of the same material as the heating section 20 and may be combined with the heating section 20 to form one body during processing.

The support structures 40 may be between the substrate 10 and the connecting sections 30, so as to support the heating section 20 and the connecting sections 30 from the bottom of the connecting sections 30. Each support 40 may make partial contact with the bottom of each connecting section 30. As shown in FIG. 1, the connecting section 30 consists of a first area A1 and a second area A2. The first area A1 corresponds to a contact area (i.e. interface) 45 between a connecting section 30 and a support structure 40, in which the connecting sections 30 and the support structure 40 come into contact with each other. The second area A2 may be between the heating section 20 and the first area A1.

Each one of the support structures 40 may be underneath an end portion of each connecting section 30, a relative distance from the heating section 20. The first area A1 of each connecting section 30 corresponds to an end portion of each connecting section 30. The contact area 45 between the connecting section 30 and the first area A1 may have a circular shape. However, example embodiments are not limited thereto, and the first area A1 or the contact area 45 may have a rectangular area or other shapes.

The support structures 40 may be made out of materials with low thermal conductivity so as to prevent the loss of heat from the heating section 20. For example, the support structures 40 may be made out of SiOx. As shown in FIGS. 1 and 2, the connecting sections 30 may be supported by the support structures 40. In addition, the heating unit 20 combined with the connecting sections 30 may form one body and may also be supported by the support structures 40.

Also, there is not much heat to be transferred from the heating section 20 to the support structures 40 because these structures may be separated from each other by the connecting sections 30, respectively. For example, temperature distribution along the heating section 20 is negligibly influenced by the shape of the support structures 40; therefore the heating section 20 may maintain a uniform temperature distribution. In addition, when the support structures 40 are placed underneath end portions of the connecting sections 30, and distant from the heating section 20, heat transfer between the heating section 20 and the support structures 40 occurs minimally. Further, even though one of the connecting sections 30 may be cut off while forming a micro-heater 50 or a certain connecting section 30 disconnected during the use of a micro-heater 50, as the heating section 20 may be connected to other connecting sections 30, the heating section 20 may be supported (indirectly) by the support structures 40, thus continuing to generate heat stably.

Figure 3:
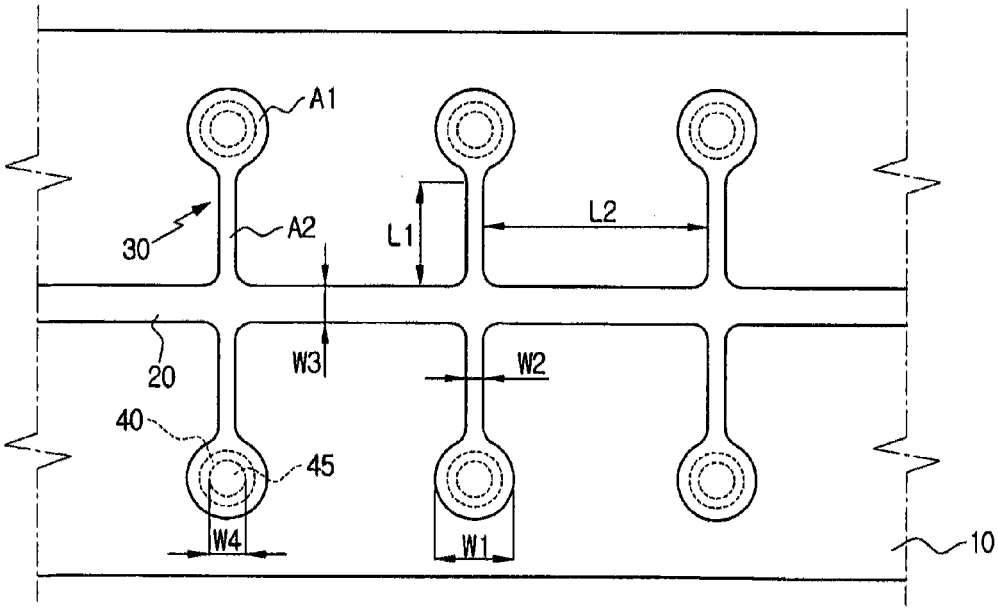

FIG. 3 illustrates a plain view of a micro-heater in FIG. 1. FIG. 3 specifies widths W1 and W2 of the connecting sections 30, length L1 of the second area A2 in the connecting sections 30, separated distance L2 between the connecting sections 30, width W3 of the heating section 20, and width W4 of the contact area 45, respectively. The power required to drive a micro-heater 50 may be reduced by decreasing and/or minimizing the size of an area involved in heat transfer between the heating section 20 and the connecting sections 30, and the size of an area involved in heat transfer between the individual connecting sections 30 and the individual support structures 40, as long as structural support is not impaired.

Heat (Q) is determined by formula 1 below:

$$Q = -kA\frac{dT}{dX} \tag{1}$$

According to formula 1, heat (Q) decreases as the area A decreases and the heat transfer distance (dX) increases. Therefore, heat (Q) being transferred from the heating section 20 to each one of the connecting sections 30 decreases as the length L1 of the second area A2 in the connecting section 30 increases while the widths W1 and W2 of the connecting sections 30 decrease. Additionally, an increase in the separated distance L2 between the connecting sections 30 decreases the heat (Q) being transferred from the heating section 20 to each one of the connecting sections 30. Therefore, using a fixed length for the heating section 20, the number of the connecting sections 30 being connected to the heating section 20 should decrease as the separated distance L2 between the connecting sections 30 increases, resulting in a reduced area for the connecting sections 30. Similarly, heat (Q) being transferred from the individual connecting sections 30 to the individual support structures 40 decreases as the width W4 of the contact area 45 decreases. Therefore, by adjusting widths W1 and W2 of the connecting sections 30, length L1 of the second area A2 in the connecting section, separated distance L2 between the connecting sections 30, and width W4 of the contact area 45, one may possibly reduce heat loss from heating section 20.

Further, as long as the structural support for the heating section 20 is maintained, the length L1 of the second area A2 in the connecting sections 30 may be maximized or the widths W1 and W2 and the contact area 45 in each one of the connecting section 30 may be minimized to reduce the loss of heat from the heating section 20. Consequently, power required to drive a micro-heater 50 may be reduced, and the power being applied may be utilized more efficiently by the heating section 20 to achieve high temperatures.

For example, as shown in FIG. 3, the width W2 of the second area A2 in the cross section 30 may be made smaller than the width W3 of the heating section 20, so that less heat may be transferred from the heating section 20 to the second area A2 in each one of the connecting sections 30. Further, to reduce the loss of heat transferred from the connecting sections 30 to the support structures 40, the size of the contact area 45 may be decreased to a minimum limit that would not impair the structural support. For example, the size of the contact area 45 may be smaller than the first area A1, and the width W4 of the contact area 45 may therefore be smaller than the width W1 of the first area A1.

However, if the contact area 45 and the first area A1 of each one of the connecting sections 30 corresponding to the contact area 45 is too small, the structural stability even with the support structure 40 may not be sufficient. Thus the contact area 45 and the first area A1 must have at least a minimum size so the support structure 40 is able to maintain (structural) support for the heating section 20 and the connecting sections 30. As shown in FIG. 3, the widths W1 and W4 of the first area A1 and contact area 45 may be designed to be greater than the width W2 of the second area A2.

Another way to control the power of the heating section 20 may be by adjusting the width W3 of the heating section 20. For example, suppose that the width W3 of the heating section 20 is doubled under the same applied voltage. Then the resistance against the current flowing through the heating section 20 is reduced by half (½), while twice the power is supplied to the heating section 20. As a result, the heating section 20 generates twice the heat and twice the light.

Figure 4:
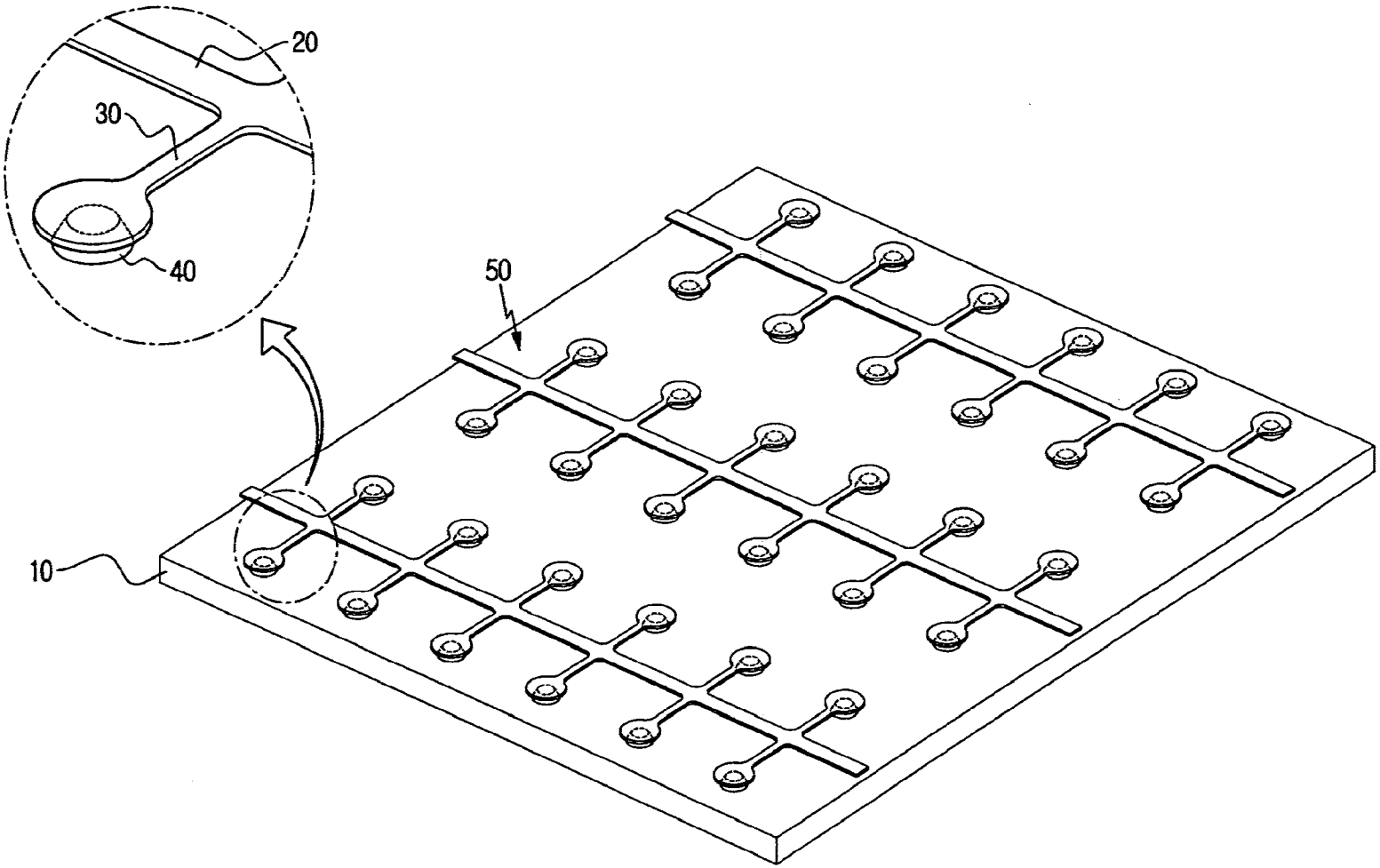

FIG. 4 is a perspective view of a micro-heater array according to example embodiments. Like reference numerals are used for like constituent elements throughout FIGS. 1-4, and detailed descriptions of the elements will not be repeated.

Referring to FIG. 4, a micro-heater array includes more than two micro-heaters 50 arranged on a substrate 10 in parallel in the same direction. A voltage may be applied to at least two micro-heaters 50 connected in parallel to each other. As temperature distribution in the micro-heater 50 is relatively uniform, a micro-heater array's size may increase by using the micro-heaters 50.

A micro-heater 50 or a micro-heater array according to example embodiments may be applied to a broad range of electronic devices such as carbon nano tube transistors, low-temperature polycrystalline silicon or thin film transistors, field emission sources of a backlight unit, etc, which may require high-temperature fabrication processes or high-temperature operations.

Figure 5A:
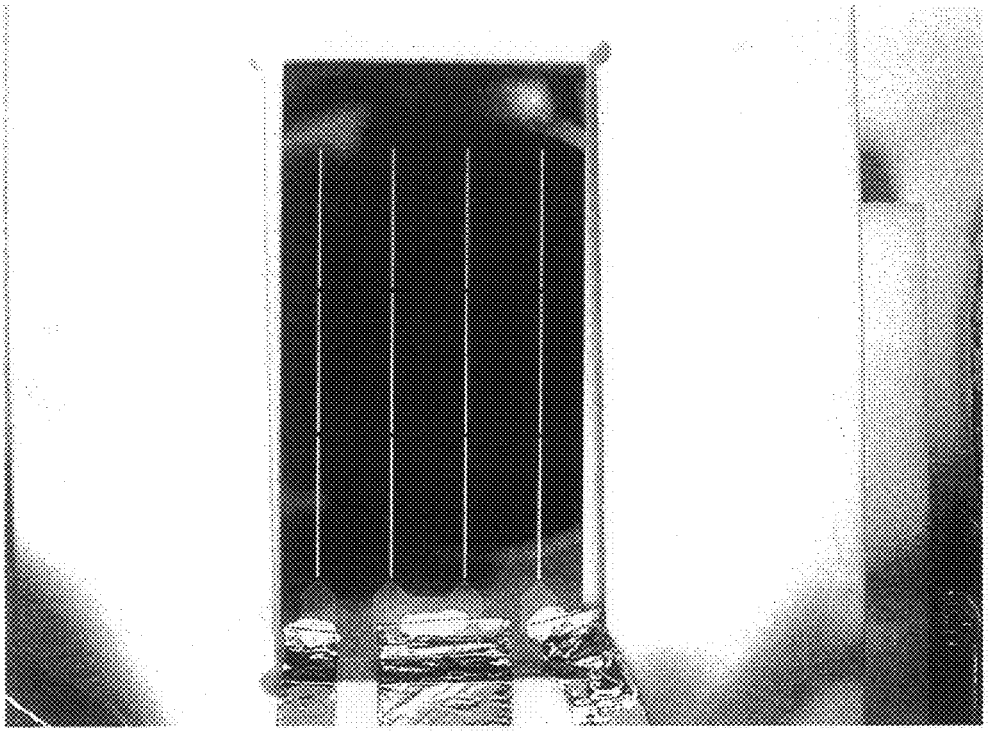
FIG. 5A and FIG. 5B show photographs of a heated state of a micro-heater in accordance with example embodiments.
Figure 5B:
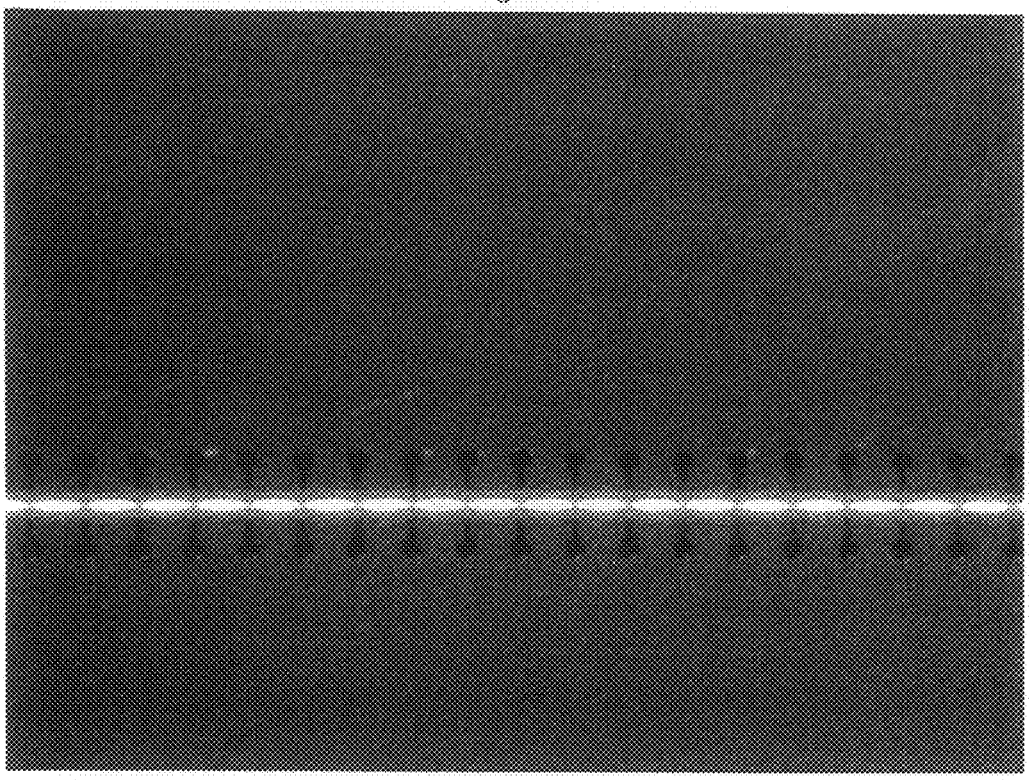

FIG. 5A and FIG. 5B show photographs of a micro-heater in a heated state in accordance with example embodiments. As shown in FIG. 5A, the temperature distribution of the heating section in a part of a micro-heater is uniform (reference numerals not shown). Also, as shown in FIG. 5B, in a micro-heater array composed of a plurality of micro-heaters arranged side by side, each one of the micro-heaters exhibits a uniformly heated state overall, for example, the temperature distribution of individual micro-heaters is uniform.

Figure 6:
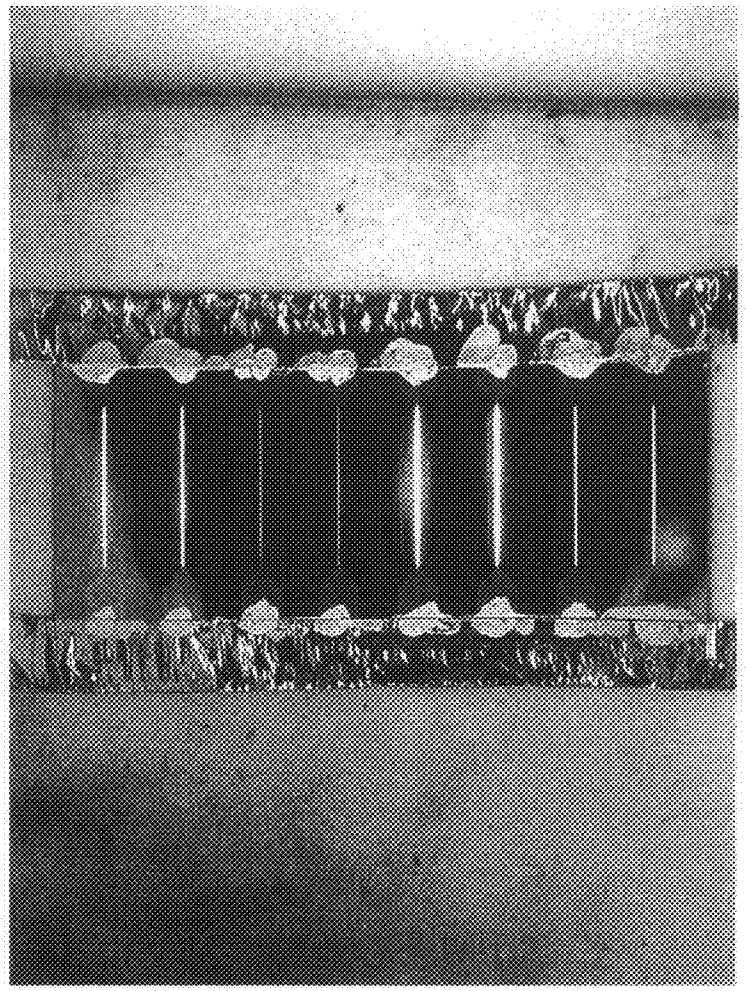
FIG. 6 is a photograph of a micro-heater array in accordance with example embodiments.

FIG. 6 is a photograph of a micro-heater array according to example embodiments, in which reference numerals for constituent elements of a micro-heater are not shown. Referring to FIG. 6, a micro-heater array includes a plurality of micro-heaters which are arranged side by side in parallel to each other. The photograph shows four pairs of micro-heaters (from top to bottom), each pair including two micro-heaters. Every micro-heater pair has different values of width W3 for the heating section 20 and of width W2 for the second area A2 of the respective connecting sections 30 (reference numerals not shown). Comparing the first pair of micro-heaters with the second pair of micro-heaters, the width W3 of the heating section 20 in the second pair of micro-heaters is greater than the width W3 of the heating section 20 in the first pair of micro-heaters. Therefore, under the same applied voltage, the micro-heaters in the second pair generate more heat than the micro-heaters in the first pair. Further, comparing the first pair of micro-heaters with the third pair of micro-heaters, the width W2 of the second area A2 of the respective connection sections 30 in the first pair of micro-heaters is smaller than the with W2 of the second area A2 of the respective connection sections 30 in the third pair of micro-heaters. Therefore, under the same applied voltage, the micro-heaters in the first pair generate more heat than the micro-heaters in the third pair.

Figure 7A:
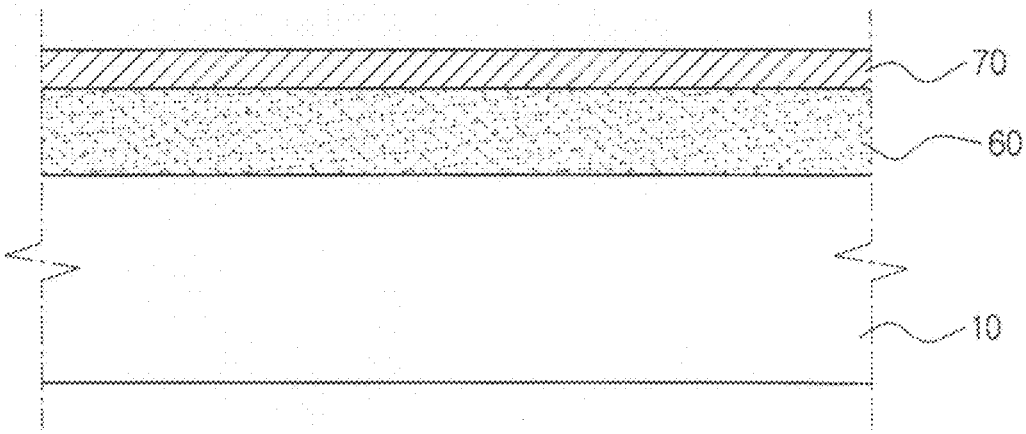
Figure 7B:
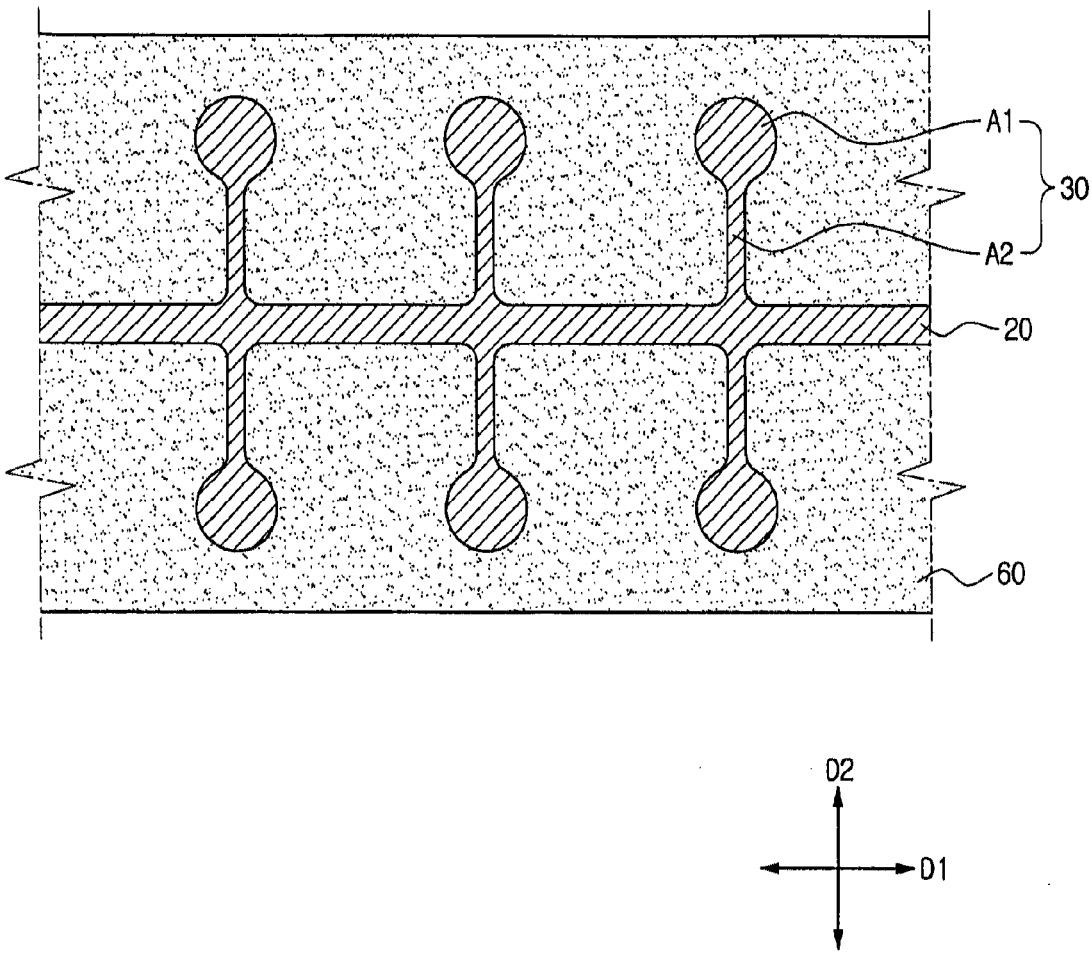
Figure 7C:
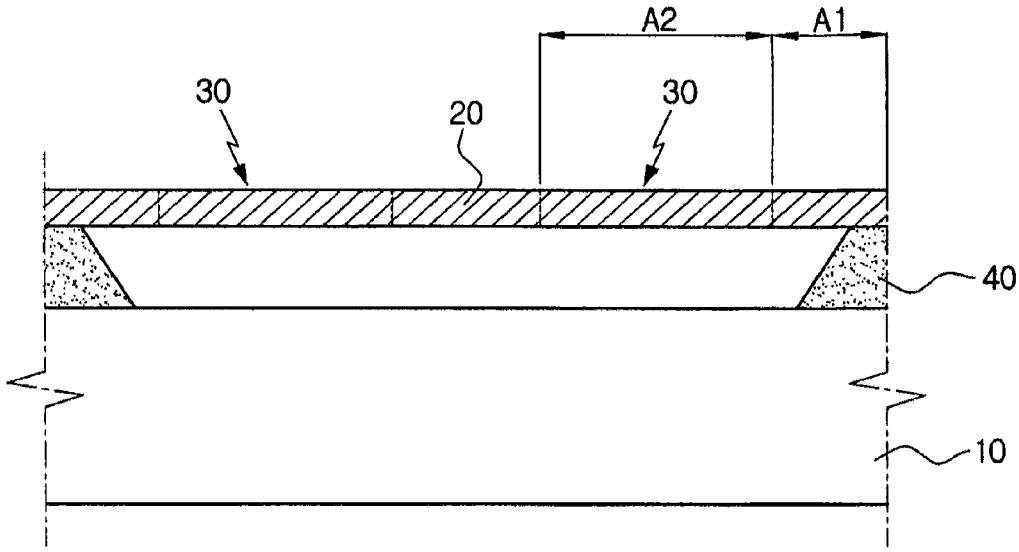

FIGS. 7A through 7C illustrate successive stages in the manufacture of a micro-heater array in accordance with example embodiments, in which FIGS. 7A and 7B are side views and FIG. 7B is a plain view. Referring to FIG. 7A, a sacrificial layer 60 (which may be etched later to form a plurality of support structures 40) may be formed on a substrate 10. A heating layer 70 may be formed on the sacrificial layer 60.

Referring to FIG. 7B, the heating layer 70 may be patterned to a heating section 20 and a plurality of connecting sections 30. The heating section 20 may extend in direction D1. The plurality of connecting sections 30 may be arranged at a distance from each other in a longitudinal direction D1 of the heating section 20, and extended from two sides of the heating section 20 in a perpendicular direction D2 with respect to the longitudinal direction D1 of the heating section 20. Each one of the connecting sections 30 may be patterned into a first area A1, and a second area A2 that is located between the heating section 20 and the first area A1 and has a smaller width than that of the first area A1. The first area A1 corresponds to a contact area (i.e. interface) between each connecting section 30 and each support structure 40 (which is formed by etching the sacrificial layer 60). The second area A2 may have a smaller width than that of the heating section 20.

Referring to FIG. 7C, the sacrificial layer 60 may be removed off by etching and formed into a plurality of support structures 40. An etching process may be applied to every part of the sacrificial layer 60 except for contact areas between each connection section 30 and each support structure 40. Therefore, the heating section 20 may be disposed over the substrate 10, being separated there from, and the support structures 40 may be disposed underneath the connecting sections 30, respectively.

To reduce heat transfer between the connecting sections 30 and the support structures 40, the etching process may be applied so, e.g. the contact area between them decreases and the size of the contact area may be smaller than the size of the first area A1 of each connecting section 30.

The foregoing is illustrative of example embodiments and is not to be construed as limiting thereof. Although a few example embodiments have been described, those skilled in the art will readily appreciate that many modifications are possible in example embodiments without materially departing from the novel teachings and advantages. Accordingly, all such modifications are intended to be included within the scope of this invention as defined in the claims. In the claims, means-plus-function clauses are intended to cover the structures described herein as performing the recited function, and not only structural equivalents but also equivalent structures. Therefore, it is to be understood that the foregoing is illustrative of various example embodiments and is not to be construed as limited to the specific embodiments disclosed, and that modifications to the disclosed embodiments, as well as other embodiments, are intended to be included within the scope of the appended claims.

What is claimed is:

1. A micro-heater arranged on a substrate, the micro-heater comprising:

a heating section on the substrate and extended in a longitudinal direction;

a plurality of connecting sections arranged in the longitudinal direction of the heating section, and extended from two sides of the heating section, each in a perpendicular direction with respect to the longitudinal direction of the heating section; and a plurality of support structures between the substrate and the plurality of connecting sections, to support the heating section and the plurality of connecting sections from underneath the plurality of connecting sections.

2. The micro-heater of claim 1, wherein each of the plurality of connecting sections is divided into:

a first area corresponding to a contact area between each of the plurality of connecting sections and each of the support structures; and a second area between the heating section and the first area and having a smaller width than a width of the first area.

3. The micro-heater of claim 2, wherein the width of the second area is smaller than a width of the heating section.

4. The micro-heater of claim 3, wherein the contact area between each of the connecting sections and each of the plurality of support structures is smaller than the first area in each of the plurality of connecting sections.

5. The micro-heater of claim 4, wherein the first area in each of the plurality of connecting sections corresponds to an end portion of each of the plurality of connecting sections.

6. The micro-heater of claim 5, wherein heat transferred from the two sides of the heating section to the respective one of the plurality of connecting sections is inversely proportional to a length of each of the plurality of connecting sections.

7. The micro-heater of claim 5, wherein heat transferred from the two sides of the heating section to the respective one of the plurality of connecting sections is proportional to a width of each of the plurality of connecting sections.

8. The micro-heater of claim 5, wherein heat transferred from the two sides of the heating section to the respective one of the plurality of connecting sections is inversely proportional to a separated distance between the plurality of connecting sections.

9. The micro-heater of claim 1, wherein the width of the heating section is adjusted to control a power of the heating section.

10. A micro-heater array comprising: two or more micro-heaters according to claim 1, in parallel on the substrate.

11. An electronic device comprising the micro-heater according to claim 1.

12. An electronic device comprising the micro-heater array of claim 10.

13. A method for manufacturing a micro-heater, comprising:

forming a sacrificial layer on a substrate;

forming a heating layer on the sacrificial layer;

patterning the heating layer into a heating section and a plurality of connecting sections, wherein the heating section is extended in a longitudinal direction, and the plurality of connecting sections are arranged in the longitudinal direction of the heating section and extended from two sides of the heating section in a perpendicular direction with respect to the longitudinal direction of the heating section; and etching the sacrificial layer except for a contact area between each of the plurality of connecting sections and each of a plurality of support structures, wherein the plurality of support structures are underneath the plurality of connecting sections and support the heating section.

14. The method of claim 13, wherein each of the connecting sections is patterned into a first area corresponding to a contact area between each of the plurality of connecting sections and each of the plurality of support structures and a second area between the heating section and the first area, the second area having a width smaller than a width of the first area.

15. The method of claim 14, wherein the second area is formed to have a smaller width than a width of the heating section.

16. The method of claim 15, wherein the contact area between each of the plurality of connecting sections and each of the plurality of support structures decreases in size so as to reduce heat transfer between the plurality of connecting sections and the plurality of support structure without impairing the structural support of the plurality of support structures supporting the heating section and the plurality of connecting sections.

17. The method of claim 16, wherein the contact area is smaller than the first area in each of the plurality of connecting sections.

18. The method of claim 17, wherein the first area in each of the plurality of connecting sections corresponds to an end portion of each of the plurality of connecting sections.

* * * * *